US006126280A

United States Patent [19]

Hashimoto et al.

[11] Patent Number: 6,126,280

[45] Date of Patent: Oct. 3, 2000

[54] INK RECORDING METHOD

[75] Inventors: Ken Hashimoto; Izuru Matsui, both of Kanagawa, Japan; Toshitake Yui, Ontario, Canada; Fuminori Koide, Kanagawa, Japan

[73] Assignee: Fuji Xerox Co., Ltd., Tokyo, Japan

[21] Appl. No.: 08/095,479

[22] Filed: Jul. 23, 1993

Related U.S. Application Data

[63] Continuation of application No. 07/737,900, Jul. 26, 1991, abandoned, which is a continuation of application No. 07/487,051, Mar. 5, 1990, abandoned.

[30] Foreign Application Priority Data

Mar. 3, 1989 [JP] Japan ..... 1-50034

[51] Int. Cl.[7] ..... B41J 2/01

[52] U.S. Cl. ..... 347/101; 347/100; 347/105

[58] Field of Search ..... 347/101, 105, 347/100, 103; 355/295

[56] References Cited

U.S. PATENT DOCUMENTS

| | | | |
|---|---|---|---|
| 3,846,151 | 11/1974 | Roteman | 355/295 X |
| 3,854,975 | 12/1974 | Brenneman | 118/653 X |
| 4,243,994 | 1/1981 | Kobayashi | 346/140 |
| 4,308,542 | 12/1981 | Maekawa | 347/102 |
| 4,348,118 | 9/1982 | Skafvenstedt | 346/136 X |
| 4,399,443 | 8/1983 | Yasufuku | 347/100 X |
| 4,409,040 | 10/1983 | Tabayashi | 347/100 X |
| 4,481,244 | 11/1984 | Haruta | 346/135.1 X |
| 4,538,156 | 8/1985 | Durkee | 346/140 R X |
| 4,542,059 | 9/1985 | Toganoh | 346/135.1 X |
| 4,745,420 | 5/1988 | Gerstenmaier | 346/140 |
| 4,889,761 | 12/1989 | Titterington | 346/1.1 X |
| 4,902,568 | 2/1990 | Morohoshi | 346/135.1 X |
| 4,914,562 | 4/1990 | Abe | 346/140 |
| 4,931,810 | 6/1990 | Iwata | 346/1.1 |
| 5,041,846 | 8/1991 | Vincent | 346/25 |
| 5,067,980 | 11/1991 | Koike | 347/100 X |
| 5,257,036 | 10/1993 | Koike | 347/100 |

FOREIGN PATENT DOCUMENTS

| | | | |
|---|---|---|---|
| 45065 | 3/1982 | Japan . | |
| 48311 | 11/1983 | Japan . | |
| 188444 | 10/1984 | Japan . | |
| 32758 | 2/1986 | Japan . | |
| 161542 | 7/1987 | Japan . | |
| 363221046 | 9/1988 | Japan | B41J 3/04 |

*Primary Examiner*—Joseph Hartary
*Attorney, Agent, or Firm*—Finnegan, Henderson, Farabow, Garrett & Dunner, L.L.P.

[57] ABSTRACT

An ink recording method is disclosed, which comprises printing a recording paper with an aqueous ink and immediately thereafter applying pressure onto the recording paper, whereby sharp images can be printed at high speed even on a plain paper.

17 Claims, 1 Drawing Sheet

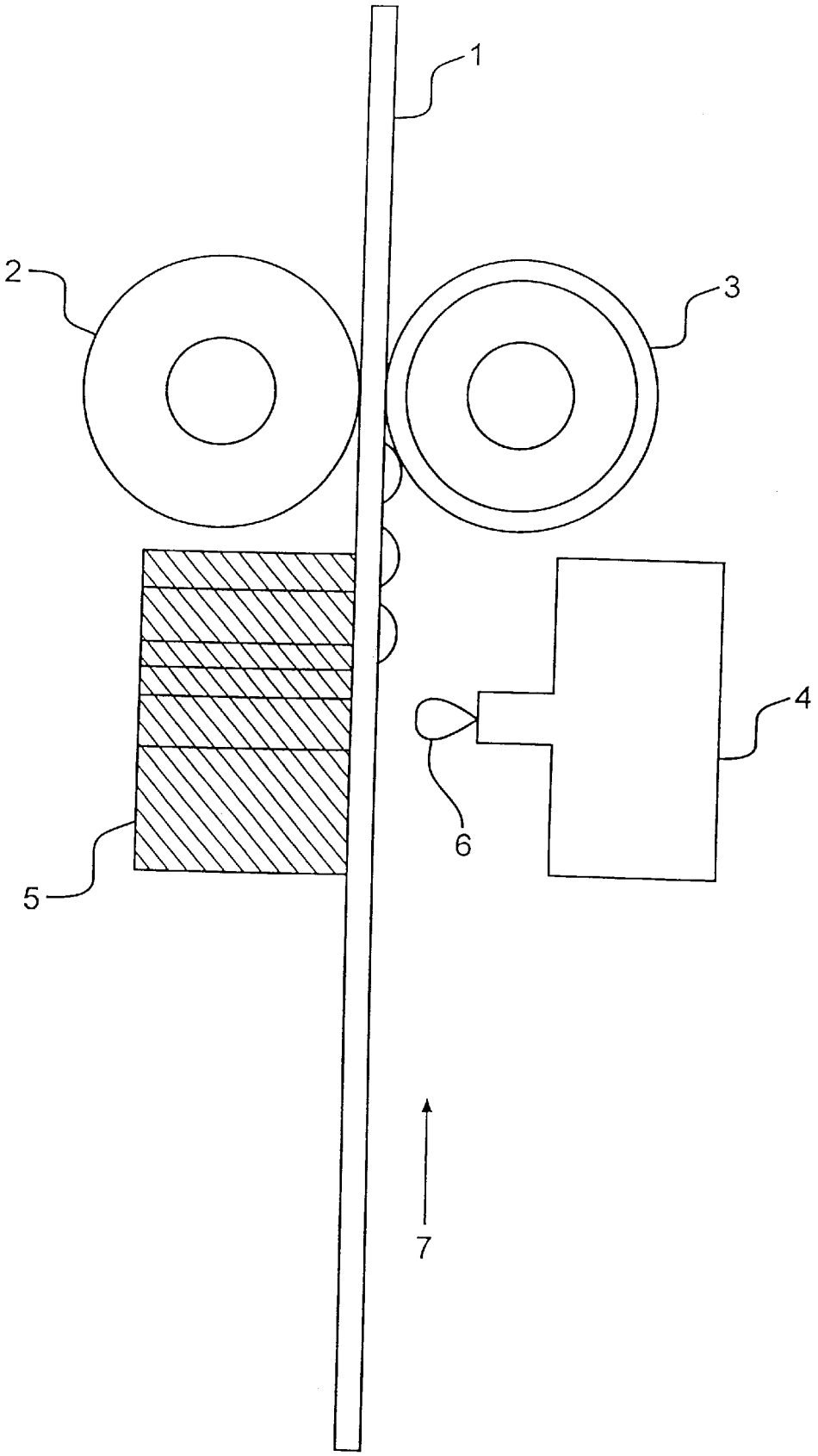
1
2
3
4
5
6
7

INK RECORDING METHOD

This application is a continuation of application Ser. No. 07/737,900 filed Jul. 26, 1991, now abandoned, which is a continuation of application Ser. No. 07/487,051 filed Mar. 5, 1990, abandoned.

FIELD OF THE INVENTION

This invention relates to an ink recording method, particularly to a recording method with an aqueous ink.

BACKGROUND OF THE INVENTION

Recently, as the printing method for performing high speed recording method, the ink jet method has been frequently utilized. This ink jet method is a method which performs printing on a recording paper by permitting ink jetted out through a nozzle, mesh-like film or slit, and generally as the ink, there has been used one comprising a dye or pigment which is the colorant, additive such as wetting agent, dissolving aid, pH controller, preservative, etc., and water or an organic solvent, and containing generally 1 to 10 wt % of the colorant.

Since a coated paper such as silica-coated paper, etc. used as a recording paper is expensive, it is desirable to use a plain paper. However, when recording is performed on a plain paper by use of an aqueous ink, because of slow penetration of aqueous ink, troubles are involved in the case of performing high speed recording, full color recording with much ink amount, etc., whereby no good printing could be done. For solving such problems, it becomes necessary (i) to remove the solvent by use of dryer, or (ii) to promote penetration of the ink into the paper by lowering the surface tension of the ink. In the case of (i), however, power is required, whereas in the case of (ii), there is the problem that the printed dot image is blurred.

The present invention has been accomplished under the state of the art as described above.

SUMMARY OF THE INVENTION

An object of the present invention is to provide an ink recording method which performs printing on a plain paper by use of an aqueous ink.

The present inventors, as the result of investigations, have found that the above object can be accomplished by an ink recording method comprises printing a recording paper with an aqueous ink, and immediately thereafter applying pressure onto the recording paper to have the ink penetrated forcibly into the paper.

BRIEF DESCRIPTION OF THE DRAWINGS

The single FIGURE is a diagrammatic general arrangement and process flow sheet of the embodiment of the process according to Example 2.

DETAILED DESCRIPTION OF THE INVENTION

In the present invention, any aqueous ink known in the art can be used, which comprises a colorant such as dye, pigment, etc. and an aqueous medium such as, water, water-soluble organic solvents, a wetting agent, etc. Examples of the organic solvent include alcohols and glycols, generally having a boiling point of at least about 100° C. and preferably about 180° C. or higher. The aqeuous medium may contain a dissolving aid, a pH controller, a preservative and the like, if desired.

Examples of the components of the aqueous medium, i.e., the organic solvent, and the additive having the functions of wetting agent, dissolving aid, etc. which are used together with water, include ethylene glycol, polyethylene glycols (e.g., diethylene glycol, triethylene glycol, tetraethylene glycol and other polyethylene glycols), propylene glycol, polypropylene glycols, butylene glycol, ethylene glycol monomethyl ether, ethylene glycol monoethyl ether, ethylene glycol, monobutyl ether, methylcarbitol, ethylcarbitol, butylcarbitol, ethylcarbitol acetate, diethylcarbitol, triethylene glycol monomethyl ether, propylene glycol monomethyl ether, glycerine, polyglycerines (e.g., diglycerine), triethanolamine, sorbitol, cyclodextrins, formamide, dimethylformamide, dimethyl sulfoxide, N-methylpyrrolidones (e.g., N-methyl-2-pyrrolidone), 1,3-dimethylimidazolidinone, urea, p-toluenesulfonic acid salt, aminoacetamide, etc., with ethylene glycol, polyethylene glycols, propylene glycol, glycerine, triethanolamine and N-methylpyrrolidone being preferred.

The aqueous ink of the present invention generally contains water in an amount of 40 to 99 wt %, preferably 50 to 95 wt % and further contain a water-soluble organic solvent in an amount of 1 to 60 wt % and preferably 5 to 50 wt % based on the weight of the ink.

For controlling ink properties such as viscosity, surface tension, pH, electroconductivity, etc., polyvinyl alcohol, polyvinyl pyrrolidone, cellulose derivatives, acrylic polymers (e.g., ammonium acrylate copolymers, etc.), water-soluble polymers (e.g., polyethyleneimine, etc.), hydrophilic polymers, block or graft copolymers constituted of hydrophilic moiety and hydrophobic moiety, polymer emulsions, polymer latices, inorganic salts such as potassium chloride, etc., organic salts, various surfactants such as cationic, anionic, nonionic types, etc. may also be contained in the aqueous ink.

For the purpose of improving fixing strength, water resistance, light resistance of the ink image, or for the purpose of improving shell life of the ink, there may be further added chelating agents such as EDTA, etc., cyclic ethers such as crown ether, etc., oxygen absorbers such as sodium sulfite, etc., lower alcohols such as ethanol, isopropanol, etc., oligosaccharides and derivatives thereof, UV-absorbers, IR-absorbers, antioxidants, sterilizers, preservatives, etc., if desired.

As the colorant, various dyes, pigments, etc. can be used. Representative examples include water-soluble dyes such as Direct Black 19, Direct Black 154, Food Black 2, Acid Blue 1, Acid Blue 9, Direct Blue 86, Acid Red 35, Acid Red 87, Acid Yellow 23, Direct Yellow 86, etc. which may be added in the form of solution dissolved in water and/or alcohol or glycol type solvents; pigments such as Pigment Yellow 12, 13, 14 or 97, Pigment Red 48, 49:1, 53:1, 57, 57:1, 81 or 122, Pigment Blue 15:3, Pigment Green 7 or 36, magnetite, ferrite, carbon black, titanium oxide, etc., which can be added as it is or in the form of dispersion together with a surfactant or a dispersing agent, in water and/or alcohol or glycol type solvents. Also, oil-soluble dyes or disperse dyes such as Solvent Yellow 19, 77 or 79, Disperse Yellow 70, etc. may also be used as the colorant by dispersing them, together with a surfactant or a dispersing aid in an aqueous medium. Further, oils, waxes, polymers, etc. colored or dyed with the above-mentioned pigments, oil-soluble dyes or reactive dyes can also be used as well as other known colorants such as polymer dyes, polymer grafted pigments, inorganic pigments, etc. Water-soluble dyes are preferably used in the present invention, and among them, acid dyes and direct dyes are particularly preferred. The content of colorant in the aqueous ink is generally from 0.1 to 15 wt % and preferably from 1 to 8 wt %.

The aqueous ink of the present invention preferably has a surface tension of at least about 30 dyn/cm, more preferably from about 30 to about 65 dyn/cm, and particularly preferably from about 35 to about 55 dyn/cm. The aqueous ink having the surface tension within the above range does not be offset onto a pressing member as described below, and provides an image without blurring. If the surface tension is lower than about 30 dyn/cm, the ink penetrates into paper too smoothly. Therefore, even when the ink is provided on the paper and fixed instantly by a roll pressing method, the ink flows along the paper fibers, whereby blurring or back penetration is liable to occur. On the other hand, if the surface tension is higher than about 65 dyn/cm, it is surely conceivable from the standpoint of surface chemistry that the ink is not likely to be offset onto a pressing member and is blurred on the paper with difficulty, but a part of the ink is scattered during application of pressure and there can be seen a tendency to form disordered image and to cause contamination of the pressing member. Further, the aqueous ink having the surface tension higher than about 65 dyn/cm must contain a large amount of water, so that the amount of a solvent or a wetting agent (e.g., glycols) is necessarily reduced. When using such an aqueous ink in ink jet recording, clogging of the nozzle tends to occur, and therefore it necessary to properly select the recording conditions.

The viscosity of the ink jet ink is set generally at 10 cp (centipoise) or less, preferably about 1 to 5 cp, and within such viscosity ranges, rollpressing is effectively carried out. Even with a higher viscosity, the aqueous ink can effectively be penetrated according to the present invention.

While the present invention enables the ink to be penetrated instantly even when a large amount of ink is provided on paper, the ink amount is preferably small so as to prevent an image flow upon application of pressure and to print images with high resolution and it is preferably not more than about 10 $\mu l/cm^2$ and more preferably about 5 $\mu l/cm^2$ or less.

In the present invention, as the plain paper, papers for electrophotographic copying machines such as Xerox Papaer L (produced by Fuji Xerox Co., Ltd.), pure paper, bond paper, etc. may be used. The weight of paper is not particularly limited and it, is generally from 60 to 90 $g/m^2$.

The pressing member to be used in the present invention may be in various forms such as plate, cube, roll, etc., and metals such as iron, aluminum, copper, etc. can be used for the pressing member. Particularly, metallic pressing members treated with surface chromium plating, etc. to provide a mirror surface, or metallic or ceramic pressing members subjected to a surface treatment with silane coupling agents, titanate coupling agents, etc. can preferably be used. Metallic or ceramic pressing members coated with synthetic resins can also be used. Examples of the synthetic resins include fluorine type resins or rubbers, such as polytetrafluoroethylene, polychlorotrifluoroethylene, tetrafluoroethylene/hexafluoropropylene copolymer, tetrafluoroethylene/perfluoroalkyl vinyl ether copolymer, ethylene/tetrafluoroethylene copolymer, ethylene/chlorotrifluoroethylene copolymer, polyvinylidene fluoride, polyvinyl fluoride, perfluoroacrylate copolymers, silicone rubber, fluorosilicone rubber, polyethylene, polypropylene, polyethylene terephthalate, etc. The pressing member may also be made of the above-mentioned synthetic, an engineering plastic (e.g., polysulfone, polyether sulfone, polyphenylene sulfide, polyether imide, polyether ether ketone, polyarylate, polyamide imide, polyimide, etc.), a general purpose plastic (e.g., styrene type plastics, polyamide type plastics, etc.) or a composite plastic compounded with a filler.

The pressing members which are surface-treated with a coupling agent or coated with a synthetic resin or those made of a synthetic resin as described above preferably possess the critical surface tension of not higher than about 35 dyn/cm, particularly preferably not higher than 30 dyn/cm. Lower surface tension is preferable because an aqueous ink is offset with more difficulty.

It is also possible to prevent an aqueous ink from adhering onto the roll by externally supplying to the surface of pressing members a releasing agent such as silicone oil, modified silicone oil, fluorine type oil, hydrocarbon type oil, or waxes that melt into oil upon heating (e.g., paraffin wax, polyethylene wax, ployproplyene wax, etc.). Alternatively, such a releasing agent may be added to the aqueous ink. Releasing agents having a surface tension of about 35 dyn/cm or less, particularly about 25 dyn/cm or less are preferably used for the purpose.

Recorded images on a recording paper may be treated, during pressing, by way of supplying to the pressing member a polymer substance, reactive substance or absorptive substance which can act as a fixing aid for the ink or dye or pigment in the ink, or as a lamination material.

In the present invention, printing can be performed on a plain paper by means of, for example, an ink jet printer.

Pressure is applied to the recording paper immediately after printing, preferably within about one minute and more preferably within about one second after printing.

Pressing can be performed by means of various devices. When. a plate is used as the pressing member, a supporting member can be arranged on the back side of the paper to effect pressing. In the case, it is desirable to clean the surface of the plate every after pressing. For cleaning, the surface of pressing member may be wiped off with a web, or a cleaning member can be slid on the surface of pressing member. When using a polygonal pressing member having many pressing surfaces which are alternatively used for pressing, cleaning of the pressing member can be done more easily. Also, a columnar or cylindrical member such as pressurizing roll can be also used as the pressing member. Roll-pressing can be effected by, for example, permitting the paper to pass through the pressing roll and a back roll and, for example, a fixing device for electrophotographic copying machine can be utilized.

Pressure to be applied in the pressing step is preferably within the range of from 1 to 300 $Kg/cm^2$ and more preferably from 10 $Kg/cm^2$ to 100 $Kg/cm^2$.

In the present invention, an aqueous ink is forcibly penetrated into a recording paper by application of pressure. Here, the penetration of ink can be considered as penetration of ink into capillary tubes in the paper. When liquid is forcibly penetrated in the capillary tubes by the application of pressure, the penetration phenomenon can generally be expressed by the following approximate equation (1):

$$h^2 = \frac{P \cdot r^2 \cdot tp}{4\eta} \tag{1}$$

wherein h is a distance for the liquid to be penetrated into the capillary tube, r is the capillary radius, n is a liquid viscosity, P is an applied pressure, and tp is time for applying pressure. On the other hand, the penetration phenomenon without the application of pressure can be expressed by the following equation (2) (Lucas-Washburn's equation):

$$h^2 = \frac{r \cdot \gamma \cos\theta \cdot tn}{2\eta} \quad (2)$$

wherein γ is a surface tension of the liquid, θ is a contact angle of the liquid with respect to the capillary tube, and tn is time for the printed liquid to spontaneously dry (due to penetration) without the application of pressure.

A minimum applied pressure required for the instant penetration of ink into the recording paper can be calculated from the equations (1) and (2):

$$\frac{P \cdot r^2 tp}{4\eta} = \frac{r \cdot \gamma \cos\theta \cdot tn}{2\eta} \quad (3)$$

$$P = \frac{2\gamma\cos\theta}{r} \cdot \frac{tn}{tp}$$

For example, when γ (the surface tension of ink) is 50 dyn/cm; the cosθ is 0. 5; r (the effective capillary radius in the paper) is 20 μm; tn (the time for spontaneously drying of the printed ink) is 100 sec; and tp (the time for applying pressure) is 0.1 sec, P (the minimum applied pressure for instant penetration) can be calculated from the equation (3), namely, P is about 25 $Kg/cm^2$.

In actual fact, however, it is difficult to measure the cosθ and the r, but as a result of various pressing tests using various kinds of paper and aqueous ink, it has been found that the applied pressure calculated by the emprical equation (4) suffices for the instant penetration:

$$P = \gamma \cdot \frac{tn}{tp} \times 10^{-3} \quad (4)$$

wherein P is an applied pressure ($Kg/cm^2$) required for instant penetration, γ is a surface tension (dyn/cm) of the ink, tn is the time (sec) for spontaneously drying of the printed ink (by penetration) without application of pressure, and tp is the time for applying pressure to the printed ink. It can be seen from the equation (4), for example, that an ink having the surface tension (γ) of 40 dyn/cm and the time for spontaneous drying (tn) of several tens seconds can be instantly penetrated by applying a pressure of several $Kg/cm^2$ to several tens $Kg/cm^2$ for 0.1 to 1 sec. While the applied pressure can be determined with reference to the equation (4), it should be noted that an optimum pressing condition varies depending upon properties of paper and ink, an amount of printed ink, the interval between the printing and pressing steps, as well as required image qualities.

By disposing the aqueous ink so as to be in contact with an intermediate drum or film instead of printing directly onto a recording paper and applying pressure between a roll and the intermediate drum, an ink image provided on the intermediate drum or film may be transferred with the application of pressure, whereby the ink can be forced to be penetrated into the recording paper.

If desired, a roll heated at about 30 to about 150° C. and preferably at about 40 to 90° C. may be used to apply pressure to the printed ink in the present invention. In the case, a heating means can be provided within the roll. The recording paper and/or the recorded image may also be subjected to heating treatment before or after pressing.

While the effect of the present invention is remarkable when performing printing of an aqueous ink on a plain paper, the present invention can be effectively applied for printing on coated paper such as silica coated paper, etc., various other papers, cloth, OHP sheet, etc. Further, it is applicable to the so-called oil type ink comprising a hydrocarbon oil, etc. as the main component, solid ink comprising a waxy substance or a jelly-like substance which can be liquefied or fluidized upon application of heating and/or pressure.

The present invention is explained with reference to the following Examples, but it is not limited thereto. The term "part" used in the Examples is by weight unless otherwise indicated.

EXAMPLE 1

| | |
|---|---|
| Deionized water | 70 parts |
| Diethylene glycol | 30 parts |
| Magenta dye (Acid Red 87) | 3 parts |

The above components were mixed, dissolved and filtered through a filter having a pore diameter of 0.5 μm to prepare an aqueous ink having a surface tension of about 45 dyn/cm.

When the aqueous ink was dropped using a microsyringe in an amount of about 0.1 μl onto a plain paper (Xerox Paper L, produced by Fuji Xerox Co., Ltd.), it was found that penetration of the ink into the paper was insufficient even after 10 seconds and an ink layer was observed on the paper.

On the other hand, when the aqueous ink was dropped onto the recording paper in the same manner and then the recording paper was passed through a pressing device using variuos rolls as described below within one second thereafter, it was found that the aqueous ink was penetrated into the paper in a moment and that disorder of ink image and offset of the aqueous ink onto the rolls were not observed.

The rolls used are as follows.

(i) Roll having a silicone rubber surface-coated layer (a fixing roll used in a copying machine FX2300 produced by Fuji Xerox Co., Ltd.);

(ii) Roll having a fluorine resin surface-coated layer (a fixing roll used in a copying machine FX2830 produced by Fuji Xerox Co., Ltd.);

(iii) Chromium-plated metal roll (a fixing roll used in a copying machine FX2000 produced by Fuji Xerox Co., Ltd.).

The rolls were used without heating.

EXAMPLE 2

The aqueous ink of Example 1 was mounted on a piezo-type drop-on-demand ink jet printer (resolution: 180 spi) and printing of dot images and solid images was performed on a plain paper (Xerox Paper L). Immediately after printing, the recording paper was passed through the pressing device using the roll having the fluorine resin-coated layer used in Example 1.

In the FIGURE in the drawing, plain paper (Xerox L) (1) travelling in the direction indicated by the arrow (7) is passed in front of a platen (5) and printed with ink (6) from an on-demand ink jet printer (4). The paper is then passed through a pressing device having pressure rolls (2,3). The pressing roll (3) has a fluorine resin-coated layer.

For comparison, the same procedure was repeated except that no roll-pressing was performed.

While expansion and blurring of printed dot images were conspicuous when no roll-pressing was performed, printed dot images having good image quality without such expansion and blurring were obtained when the roll-pressing was performed.

With respect to the solid image portion, the ink was momentarily penetrated into the paper with the application of pressure, whereas when no roll-pressing was performed, the image portion was wet even after 10 seconds and hands were stained when touched.

EXAMPLE 3

Chinese characters and solid images were printed on a plain paper in the same manner as in Example 2, except that the roll was changed to the silicone rubber-coated roll used in Example 1 which was heated to the surface temperature of about 120° C. As a result, printing was excellent with respect to both chinese characters and solid images.

EXAMPLE 4

| | |
|---|---|
| Deionized water | 90 parts |
| Diethylene glycol | 10 parts |
| Black dye (Food Black 2) | 3 parts |

The above components were mixed, dissolved and filtered through a filter having a pore diameter of 0.5 μm to prepare an aqueous ink having a surface tension of about 53 dyn/cm.

The aqueous ink was used for printing onto a plain paper in the same manner as in Example 2. As a result, extremely good images were obtained.

For comparison, the same procedure was repeated, except that the roll-pressing was not effected. As a result, the printing quality itself was found to be considerably good, with respect to blurring, though it was slightly inferior. This is considered to be due to high surface tension of the ink. However, penetration of the ink was extremely slow and, even one minute after printing, the image was still wet and contaminated hands.

EXAMPLE 5

| | |
|---|---|
| Deionized water | 70 parts |
| Ethylene glycol | 30 parts |
| Polyoxyethylene nonylphenyl ether | 0.5 part |
| Blue dye (Direct Blue 86) | 2 parts |

The above components were mixed, dissolved and filtered through a filter having a pore diameter of 0.5 μm to prepare an ink of cyan color. The ink had a surface tension of about 36 dyn/cm.

The aqueous ink was used for printing onto a plain paper in the same manner as in Example 2. As a result, very sharp prints were obtained, though slight blurring was observed.

For comparison, the same procedure was repeated without the roll-pressing. As a result, although penetration of the ink was completed about 20 seconds after printing, the images exhibited remarkable blurring.

EXAMPLE 6

| | |
|---|---|
| Deionized water | 85 parts |
| Ethylene glycol | 10 parts |
| N-methyl-2-pyrrolidone | 5 parts |
| Yellow dye (Acid Yellow 23) | 3 parts |

The above components were mixed, dissolved and filtered through a filter having a pore diameter of 0.5 μm to prepare an ink of yellow color. The ink had a surface tension of about 50 dyn/cm.

The aqueous ink was used for printing onto a plain paper in the same manner as in Example 3, except that the pressing roll was not heated. As a result, very sharp prints were obtained.

Further, the ink was mounted onto an ink jet printer (Desk Jet, produced by Hulette Packard Co.) which jets ink with a thermal head, and printing test was conducted with the same roll-pressing means as above. As a result, very sharp prints were obtained.

EXAMPLE 7

| | |
|---|---|
| Deionized water | 65 parts |
| Propylene glycol | 25 parts |
| Styrene/butyl acrylate/ammonium methacrylate copolymer | 7 parts |
| Blue dye (Copper phthalocyanine) | 5 parts |

The above components were fixed, dissolved and filtered through a filter having a pore diameter of 0.5 μm to prepare an ink of cyan color. The ink had a surface tension of about 41 dyn/cm.

Using this aqueous ink, printing was performed in the same manner as in Example 6. As a result, very sharp blue prints were obtained.

EXAMPLE 8

| | |
|---|---|
| Deionized water | 90 parts |
| Glycerine | 10 parts |
| Black dye (Food Black 2) | 3 parts |

The above components were mixed, dissolved and filtered through a filter having a pore diameter of 0.5 μm to prepare an ink having a surface tension of about 50 dyn/cm and a viscosity of about 1.3 cp.

The aqueous ink was mounted on a piezo-type drop-on-demand ink jet printer (resolution: 360 dpi) and printing was performed onto a plain paper (Xerox Paper L). After solid image printing, the printed paper was rubbed with a rolling pin and the time when no ink was attached onto the rolling pin was measured as the drying time. The drying time (tn) under the spontaneously drying state, i.e., without application of pressure, was 50 sec.

In contrast, when the printed paper was passed, within one second after printing, through the fluorine resin-coated roll of Example 1 at the pressures (P) of 10, 30 and 50 Kg/cm$^2$, respectively, for a pressing time (tp) of 0.1 sec., drying completed during the roll pressing with the pressure of 30 or 50 Kg/cm$^2$, while with the pressure of 10 Kg/cm$^2$, drying completed within several seconds after the roll pressing. Each of the thus printed images had very good image quality without blurring.

EXAMPLE 9

| | |
|---|---|
| Deionized water | 95 parts |
| Diethylene glycol | 5 parts |
| Magenta dye (Acid Red 87) | 3 parts |
| Nonionic surfactant | 0.1 part |

The above components were mixed, dissolved and filtered through a filter having a pore diameter of 0.5 $\mu$m to prepare an ink of having a surface tension of about 35 dyn/cm and a viscosity of about 1.2 cp.

Using the ink, printing was conducted in the same manner as in Example 8. A a result, the drying time (tn) under the spontaneously drying, state was 35 sec. In contrast, when the printed paper was passed, within one second after printing, through the fluorine resin-coated roll-of Example 1 at the pressure (P) of 15 Kg/cm$^2$ for the pressing time (tp) of 0.1 sec., drying was completed at a moment and the image quality was found to be good.

EXAMPLE 10

| | |
|---|---|
| Deionized water | 90 parts |
| Ethylene glycol | 5 parts |
| N-methyl-2-pyrrolidone | 5 parts |
| Yellow dye (Acid Yellow) | 3 parts |

The above components were mixed, dissolved and filtered throughi a filter having a pore diameter of 0.5 $\mu$m to prepare an ink having a surface tension of about 46 dyn/cm and a viscosity of about 1.2 cp.

The tests were conducted in the same manner as in Example 8. As a result, the drying time (tn) under the spontaneously drying state was 45 sec. In contrast, when the printed paper wa passed, within one second after printing, through the fluorine resin-coated roll of Example 1 at the pressure (P) of 30 Kg/cm$^2$ for the pressing time (tp) of 0.1 sec., drying was completed at a moment and the image quality was found to be good.

EXAMPLE 11

| | |
|---|---|
| Deionized water | 70 parts |
| Diethylene glycol | 28 parts |
| Triethanolamine | 2 parts |
| Cyan dye (Direct Blue 86) | 2 parts |
| Nonionic surfactant | 0.2 part |

The above components were mixedr dissolved and filtered through a filter having a pore diameter of 0.5 $\mu$m to prepare an ink having a surface tension of about 38 dyn/cm and a viscosity of about 2.8 cp.

The tests were conducted in the same manner an in Example 8. As a result, the drying time (tn) under the spontaneously drying state was 120 sec. and the image exhibited conspicuous blurring. In contrast, when the printed paper was passed, within one second after printing, through the silicon. resin-coated roll of Example 1 at the pressure (P) of 20 Kg/cm$^2$, for the pressing time (tp) of 0.3 sec., drying was completed at a moment and the image quality was found to be good.

EXAMPLE 12

Using the aqueous ink of Example 8, printing was performed in the same manner as in example 8 to print a line image without the roll-pressing, and then the aqueous ink Example 9 was printed on the printed paper having the line image, followed by spontaneous drying. An a result, blurring of the mixed color portion was remarkable.

When the roll-pressing was performed immediately after the printing of the ink of Example 9 at tp=0.1 sec. and p=15 Kg/cm$^2$, an extremely good image without blurring at the mixed color portion was obtained.

EXAMPLE 13

The ink of Example 9 was used for printing with the thermal ink jet printer (Desk Jet), an used in Example 6 and the printed paper was evaluated in the same manner as in Example 9. As a result, good image quality as in Example 9 was obtained when the roll-pressing was performed.

While the invention has been described in detail and with reference to specific embodiments thereof, it will be apparent to one skilled in the art that various changes and modifications can be made therein without departing from the spirit and scope thereof.

What is claimed is:

1. An ink recording method for forming an image on a plain paper comprising:

printing the plain paper having a weight of from about 60 to 90 g/m$^2$ with an aqueous ink having a surface tension of 30 to 65 dyne/cm, and immediately thereafter, within 60 seconds after printing, applying from 1 to 300 Kg/cm$^2$ pressure on the plain paper, whereby the ink is penetrated forcibly into the plain paper.

2. An ink recording method according to claim 1, wherein the aqueous ink has a surface tension of 35 to 55 dyn/cm.

3. An ink recording method according to claim 1, wherein the applied pressure is from 10 to 100 Kg/cm$^2$.

4. An ink recording method according to claim 1, wherein the pressure is applied with a pressing member having the critical surface tension of not higher than 35 dyn/cm.

5. An ink recording method according to claim 1, wherein the pressure is applied within 1 second after printing.

6. An ink recording method according to claim 1, wherein the method further comprises using a releasing agent.

7. An ink recording method according to claim 6, wherein the releasing agent is added to the aqueous ink.

8. An ink recording method according to claim 6, wherein the releasing agent is applied to the surface of the pressing member.

9. An ink recording method according to claim 6, wherein the releasing agent has a surface tension of less than or equal to 35 dyn/cm.

10. An ink recording method according to claim 1, wherein said aqueous ink comprises 40 to 99% by weight of water, 1 to 60% by weight of a water soluble organic solvent, and 0.1 to 15% by weight of a colorant, each based on the weight of ink.

11. An ink recording method according to claim 10, wherein said colorant is a water soluble dye.

12. An ink recording method according to claim 11, wherein said water-soluble dye is an acid dye or a direct dye.

13. An ink recording method according to claim 1, wherein said aqueous ink has a viscosity of less than or equal to 10 cp.

14. An ink recording method according to claim 13, wherein said aqueous ink has a viscosity of from about 1 to 5 cp.

15. An ink recording method according to claim 1, wherein said aqueous ink is provided on the recording paper in an amount of not more than about $10\mu 1/cm^2$.

16. An ink recording method according to claim 15, wherein said aqueous ink is provided on the recording paper in an amount of not more than about $5\mu 1/cm^2$.

17. An ink recording method according to claim 1, wherein said amount of pressure applied is expressed by the equation:

$$P = \gamma \cdot \frac{tn}{tp} \times 10^{-3}$$

wherein γ is the surface tension of the ink in dyne/cm, tn is the ink drying time in seconds and tp is the pressure application time in seconds.

* * * * *